US009202407B2

(12) United States Patent
Sun et al.

(10) Patent No.: US 9,202,407 B2
(45) Date of Patent: Dec. 1, 2015

(54) ORGANIC LIGHT EMITTING DIODE DISPLAY APPARATUS AND PIXEL CIRCUIT THEREOF

(71) Applicant: Chunghwa Picture Tubes, LTD., Taoyuan (TW)

(72) Inventors: Bo-Jhang Sun, Kaohsiung (TW); Chin-Hai Huang, Taoyuan County (TW); Szu-Chi Huang, Changhua County (TW)

(73) Assignee: Chunghwa Picture Tubes, LTD., Taoyuan (TW)

( * ) Notice: Subject to any disclaimer, the term of this patent is extended or adjusted under 35 U.S.C. 154(b) by 389 days.

(21) Appl. No.: 13/845,034

(22) Filed: Mar. 17, 2013

(65) Prior Publication Data

US 2014/0209868 A1 Jul. 31, 2014

(30) Foreign Application Priority Data

Jan. 25, 2013 (TW) ..... 102103006 A

(51) Int. Cl.
*G09G 3/30* (2006.01)
*G09G 3/32* (2006.01)

(52) U.S. Cl.
CPC ..... *G09G 3/30* (2013.01); *G09G 3/3233* (2013.01); *G09G 3/3258* (2013.01); *G09G 2300/0842* (2013.01); *G09G 2310/0251* (2013.01)

(58) Field of Classification Search
CPC ..... G09G 3/3233; G09G 3/3258; G09G 2310/0251; G09G 2300/0842
See application file for complete search history.

(56) References Cited

U.S. PATENT DOCUMENTS

| | | | | |
|---|---|---|---|---|
| 8,665,185 | B2 * | 3/2014 | Fan et al. | 345/76 |
| 2010/0253666 | A1 * | 10/2010 | Yamamoto | 345/211 |
| 2011/0090137 | A1 * | 4/2011 | Liu et al. | 345/76 |
| 2011/0115764 | A1 | 5/2011 | Chung | |
| 2012/0162175 | A1 | 6/2012 | Fan et al. | |
| 2012/0287103 | A1 * | 11/2012 | Wu et al. | 345/211 |

FOREIGN PATENT DOCUMENTS

| | | |
|---|---|---|
| CN | 202339694 | 7/2012 |
| TW | 200839713 | 10/2008 |
| TW | 201227682 | 7/2012 |

OTHER PUBLICATIONS

"Office Action of China Counterpart Application", issued on Aug. 6, 2014, p. 1-p. 16.
"Office Action of Taiwan Counterpart Application," issued on Dec. 26, 2014, p. 1-p. 10.

* cited by examiner

*Primary Examiner* — Kumar Patel
*Assistant Examiner* — Afroza Chowdhury
(74) *Attorney, Agent, or Firm* — Jianq Chyun IP Office

(57) ABSTRACT

An organic light emitting diode display apparatus and a pixel circuit thereof are provided. The pixel circuit includes a switch unit, a capacitor, a first transistor, a second transistor, a third transistor and an organic light emitting diode. In a pre-charging period, a first terminal of the capacitor receives a data voltage through the switch unit, and a second terminal of the capacitor receives a high voltage through the turned-on first transistor. In a programming period, the first terminal of the capacitor receives the data voltage through the switch unit, and the second terminal of the capacitor receives the high voltage that is encoded through the turned-on second and third transistors. In a display period, the first terminal of the capacitor receives a ground voltage through the switch unit, and the first and third transistors are turned-off.

18 Claims, 5 Drawing Sheets

ORGANIC LIGHT EMITTING DIODE DISPLAY APPARATUS AND PIXEL CIRCUIT THEREOF

CROSS-REFERENCE TO RELATED APPLICATION

This application claims the priority benefit of Taiwan application serial no. 102103006, filed on Jan. 25, 2013. The entirety of the above-mentioned patent application is hereby incorporated by reference herein and made a part of this specification.

FIELD OF THE INVENTION

The invention relates to a display apparatus and a pixel circuit thereof, and more particularly to an organic light emitting diode display apparatus and a pixel circuit thereof.

DESCRIPTION OF RELATED ART

Along with technological advances, flat panel displays have been the display technology receiving the most attention in recent years. Among them, organic light emitting diode (OLED) displays, with advantages such as self-luminescence, wide view angle, low power consumption, simple process, low cost, low work temperature range, high responsive speed and full colorization, have huge application potential and are thus expected to become the mainstream of next-generation flat panel displays.

An organic light emitting diode is usually serially connected to a transistor to control luminescence brightness of the organic light emitting diode. Through control of the conduction degree of the transistor, currents passing through the organic light emitting diode are controlled, and further, the luminescence brightness of the organic light emitting diode is controlled. In general, due to difference in line impedance, high voltages received by each pixel may differ from each other. Consequently, when the transistor coupled to the organic light emitting diode in different pixels is turned-on and each pixel is displayed in the same gray scale, the currents passing through the organic light emitting diode of each pixel may differ from each other, thus affecting display quality of the organic light emitting diode display. Therefore, how to eliminate influence of line impedance through circuit design has become an important topic in driving the organic light emitting diode.

SUMMARY OF THE INVENTION

The invention proposes an organic light emitting diode display apparatus, and a pixel circuit thereof to improve its display quality.

The invention provides a pixel circuit including a switch unit, a capacitor, a first transistor, a second transistor, a third transistor and an organic light emitting diode. The switch unit receives a data voltage, a scan signal and a ground voltage, and provides the data voltage or the ground voltage according to the scan signal. A first terminal of the capacitor is coupled to the switch unit to receive the data voltage or the ground voltage. A first terminal of the first transistor is coupled to the high voltage, a second terminal of the first transistor is coupled to a second terminal of the capacitor, and a control terminal of the first transistor receives a first switch signal. A first terminal of the second transistor is coupled to a high voltage, and a control terminal of the second transistor is coupled to the second terminal of the capacitor. A first terminal of the third transistor is coupled to a second terminal of the second transistor, a second terminal of the third transistor is coupled to the second terminal of the capacitor, and a control terminal of the third transistor receives a second switch signal. An anode of the organic light emitting diode is coupled to the second terminal of the second transistor, and a cathode of the organic light emitting diode is coupled to a system low voltage. In a pre-charging period, the first terminal of the capacitor receives the data voltage through the switch unit and the second terminal of the capacitor receives the high voltage through the turned-on first transistor. In a programming period, the first terminal of the capacitor receives the data voltage through the switch unit and the second terminal of the capacitor receives the high voltage that is encoded through the turned-on second and third transistors. In a display period, the first terminal of the capacitor receives the ground voltage through the switch unit and the first and third transistors are off.

The invention also provides an organic light emitting diode display apparatus including a power circuit and a pixel circuit. The power circuit is configured to provide a high voltage and a system low voltage. The pixel circuit includes a switch unit, a capacitor, a first transistor, a second transistor, a third transistor and an organic light emitting diode. The switch unit receives a data voltage, a scan signal and a ground voltage, and provides the data voltage or the ground voltage according to the scan signal. A first terminal of the capacitor is coupled to the switch unit to receive the data voltage or the ground voltage. A first terminal of the first transistor is coupled to the high voltage, a second terminal of the first transistor is coupled to a second terminal of the capacitor, and a control terminal of the first transistor receives a first switch signal. A first terminal of the second transistor is coupled to the high voltage, and a control terminal of the second transistor is coupled to the second terminal of the capacitor. A first terminal of the third transistor is coupled to a second terminal of the second transistor, a second terminal of the third transistor is coupled to the second terminal of the capacitor, and a control terminal of the third transistor receives a second switch signal. An anode of the organic light emitting diode is coupled to the second terminal of the second transistor, and a cathode of the organic light emitting diode is coupled to the system low voltage. In a pre-charging period, the first terminal of the capacitor receives the data voltage through the switch unit and the second terminal of the capacitor receives the high voltage through the turned-on first transistor. In a programming period, the first terminal of the capacitor receives the data voltage through the switch unit and the second terminal of the capacitor receives the high voltage that is encoded through the turned-on second and third transistors. In a display period, the first terminal of the capacitor receives the ground voltage through the switch unit and the first and third transistors are off.

In an embodiment of the invention, the switch unit includes a fourth transistor and a fifth transistor. A first terminal of the fourth transistor is coupled to the data voltage, a second terminal of the fourth transistor is coupled to the first terminal of the capacitor, and a control terminal of the fourth transistor receives the scan signal. A first terminal of the fifth transistor is coupled to the first terminal of the capacitor, a second terminal of the fifth transistor is coupled to the ground voltage, and a control terminal of the fifth transistor receives the scan signal. The fourth transistor is turned-on in the pre-charging period and the programming period, and the fifth transistor is turned-on in the display period.

In an embodiment of the invention, the first transistor, the second transistor, the third transistor and the fourth transistor are p-type transistors, and the fifth transistor is an n-type transistor.

In an embodiment of the invention, in the pre-charging period and the programming period, the scan signal that is enabled turns-on the fourth transistor and turns-off the fifth transistor. In the display period, the scan signal that is disabled turns-off the fourth transistor and turns-on the fifth transistor.

In an embodiment of the invention, the pixel circuit further includes a sixth transistor. A first terminal of the sixth transistor is coupled to the second terminal of the second transistor, a second terminal of the sixth transistor is coupled to the anode of the organic light emitting diode, and a control terminal of the sixth transistor receives a third switch signal, wherein the sixth transistor is turned-off in the pre-charging period and the programming period and is turned-on in the display period.

In an embodiment of the invention, the switch unit includes a seventh transistor and an eighth transistor. A first terminal of the seventh transistor is coupled to the data voltage, a second terminal of the seventh transistor is coupled to the first terminal of the capacitor, and a control terminal of the seventh transistor receives the scan signal. A first terminal of the eighth transistor is coupled to the first terminal of the capacitor, a second terminal of the eighth transistor is coupled to the ground voltage, and a control terminal of the eighth transistor receives a reverse signal of the scan signal. The seventh transistor is turned-on in the pre-charging period and the programming period, and the eighth transistor is turned-on in the display period.

In an embodiment of the invention, the first transistor, the second transistor, the third transistor, the seventh transistor and the eighth transistor are p-type transistors.

In an embodiment of the invention, in the pre-charging period and the programming period, the scan signal that is enabled turns-on the seventh transistor and turns-off the eighth transistor. In the display period, the scan signal that is disabled turns-off the seventh transistor and turns-on the eighth transistor.

In an embodiment of the invention, in the pre-charging period and the programming period, a voltage level of the system low voltage is increased to subject the organic light emitting diode is reverse-biased and turned-off. In the display period, the voltage level of the system low voltage is recovered.

In an embodiment of the invention, in the pre-charging period, the first switch signal that is enabled turns-on the first transistor and the second switch signal that is disabled turns off the third transistor. In the programming period, the first switch signal that is disabled turns-off the first transistor and the second switch signal that is enabled turns-on the third transistor. In the display period, the first switch signal that is disabled turns-off the first transistor and the second switch signal that is disabled turns-off the third transistor.

Based on the above, the organic light emitting diode display apparatus and the pixel circuit thereof according to the embodiments of the invention make it possible that after driving of the various switch signals and scan signals, currents passing through the organic light emitting diode in the display period vary correspondingly to the data voltage, regardless of the high voltage and a threshold voltage of the transistor. Accordingly, the influence of line impedance is eliminated and the display quality of the organic light emitting diode display apparatus is improved.

To make the aforementioned features and advantages of the invention more comprehensible, embodiments accompanied with figures are described in detail below.

DESCRIPTION OF THE EMBODIMENTS

Figure 1:
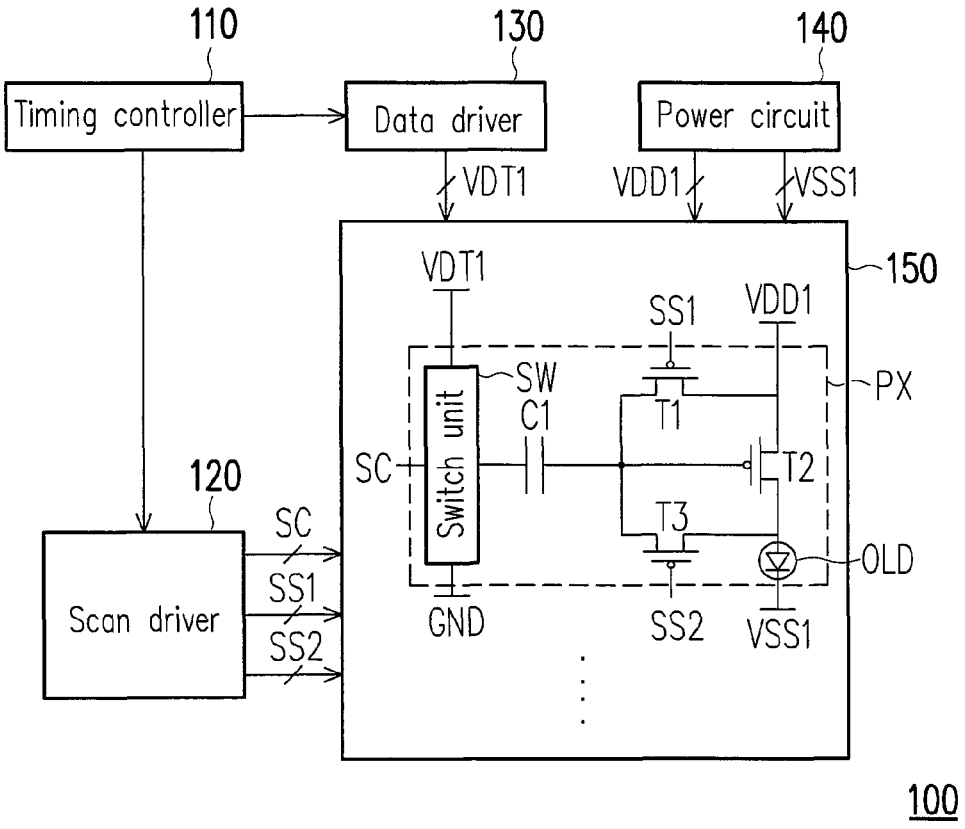
FIG. 1 is a schematic view of an organic light emitting diode display apparatus according to an embodiment of the invention.

FIG. 1 is a schematic view of an organic light emitting diode display apparatus according to an embodiment of the invention. In the present embodiment, an organic light emitting diode display apparatus 100 includes a timing controller 110, a scan driver 120, a data driver 130, a power circuit 140 and a display panel 150. The scan driver 120 is coupled to the timing controller 110 and the display panel 150, and is controlled by the timing controller 110 to provide a plurality of scan signals SC and switch signals SS1 and SS2 (equivalent to a first switch signal and a second switch signal) to the display panel 150. The data driver 130 is coupled to the timing controller 110 and the display panel 150, and is controlled by the timing controller 110 to provide a plurality of data voltages VDT1 to the display panel 150.

The power circuit 140 is coupled to the display panel 150, and provides a high voltage VDD1 and a system low voltage VSS1 to the display panel 150. The display panel 150 has a plurality of pixels PX, and each pixel PX receives the high voltage VDD1, the system low voltage VSS1, the corresponding data voltage VDT1, the corresponding scan signal SC and the corresponding switch signals SS1 and SS2.

In the present embodiment, the pixel PX includes a switch unit SW, a capacitor C1, transistors T1~T3 (equivalent to first to third transistors) and an organic light emitting diode OLD. The switch unit SW receives the data voltage VDT1, the scan signal SC and a ground voltage GND, and provides the data voltage VDT1 or the ground voltage GND according to the scan signal SC. A first terminal of the capacitor C1 is coupled to the switch unit SW to receive the data voltage VDT1 or the ground voltage GND. A source (equivalent to a first terminal) of the transistor T1 is coupled to the high voltage VDD1, a drain (equivalent to a second terminal) of the transistor T1 is coupled to a second terminal of the capacitor C1, and a gate (equivalent to a control terminal) of the transistor T1 receives the switch signal SS1. A source (equivalent to a first terminal) of the transistor T2 is coupled to the high voltage VDD1, and a gate (equivalent to a control terminal) of the transistor T2 is coupled to the second terminal of the capacitor C1. A source (equivalent to a first terminal) of the transistor T3 is coupled to a drain of the transistor T2, a drain (equivalent to a second terminal) of the transistor T3 is coupled to the second terminal of the capacitor C1, and a gate (equivalent to a control terminal) of the transistor T3 receives the switch signal SS2. An anode of the organic light emitting diode OLD is coupled to the drain of the transistor T2, and a cathode of the organic light emitting diode OLD is coupled to the system low voltage VSS1.

Figure 2A:
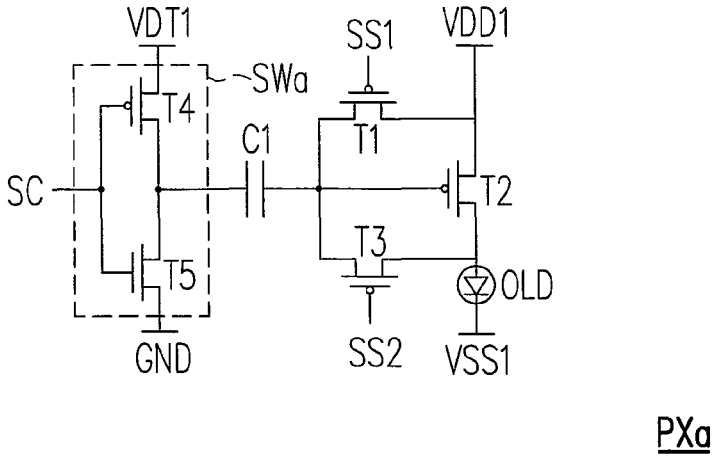
FIG. 2A illustrates a pixel circuit according to an embodiment of the invention in FIG. 1.

FIG. 2A illustrates a pixel circuit according to an embodiment of the invention in FIG. 1. Referring to FIGS. 1 and 2A, in the present embodiment, a switch unit SWa of a pixel PXa includes transistors T4 and T5 (equivalent to fourth and fifth transistors). Furthermore, it is assumed herein that the transistors T1~T4 are all p-type transistors and the transistor T5 is an n-type transistor. A source (equivalent to a first terminal) of the transistor T4 receives the data voltage VDT1, a drain (equivalent to a second terminal) of the transistor T4 is coupled to the first terminal of the capacitor C1, and a gate (equivalent to a control terminal) of the transistor T4 receives the scan signal SC. A drain (equivalent to a first terminal) of the transistor T5 is coupled to the first terminal of the capacitor C1, a source (equivalent to a second terminal) of the transistor T5 is coupled to the ground voltage GND, and a gate (equivalent to a control terminal) of the transistor T5 receives the scan signal SC.

Figure 2B:
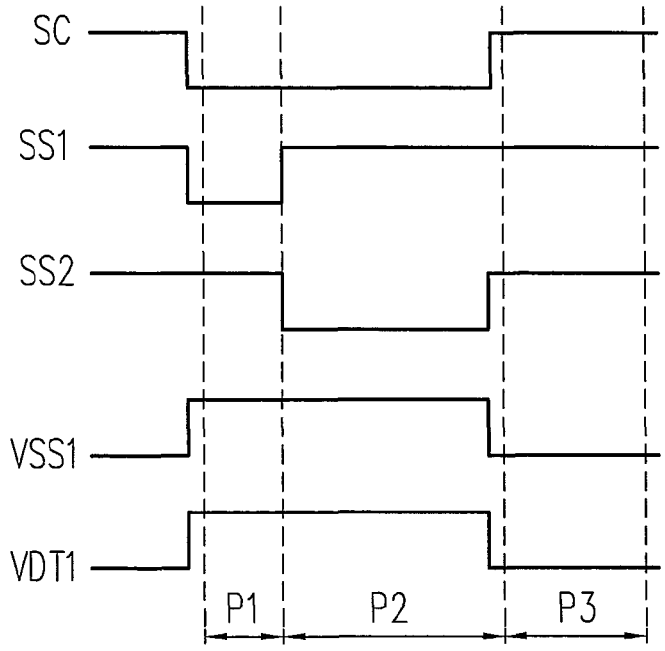
FIG. 2B is a schematic view of driving waveforms according to the embodiment of FIG. 2A.

FIG. 2B is a schematic view of driving waveforms according to the embodiment of FIG. 2A. Referring to FIGS. 2A and 2B, in the present embodiment, operation of the pixel PXa is divided into three periods, i.e. a pre-charging period P1, a programming period P2 and a display period P3. In these periods, the operation of the pixel PXa is controlled by, respectively, the scan signal SC and the switch signals SS1 and SS2, the system low voltage VSS1 and the data voltage VDT1. The operation of the pixel PXa in the pre-charging period P1, the programming period P2 and the display period P3 is described in detail hereinafter.

Figure 3A:
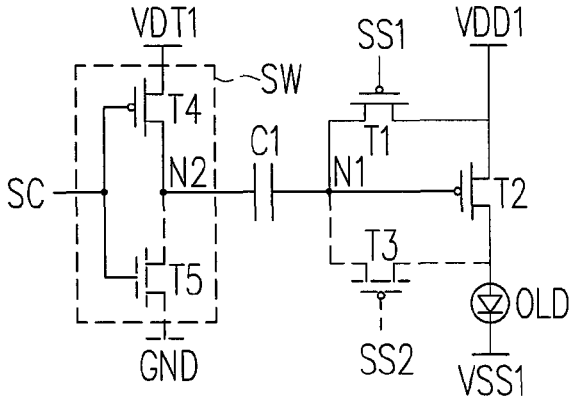
FIG. 3A is a schematic view of operation of pixels in a pre-charging period according to the embodiment of FIGS. 2A and 2B.

FIG. 3A is a schematic view of operation of pixels in a pre-charging period according to the embodiment of FIGS. 2A and 2B. Please refer to FIGS. 2A, 2B and 3A. In the pre-charging period P1 in the present embodiment, the scan signal is enabled (a low voltage level is exemplified here), and the enabling scan signal SC turns-on the transistor T4 and turns-off the transistor T5. Therefore, the first terminal (i.e. node N2) of the capacitor C1 is able to receive the data voltage VDT1 through the turned-on transistor T4 in the switch unit SWa. The switch signal SS1 is enabled (a low voltage level is exemplified here), and the enabling switch signal SS1 turns-on the transistor T1; the switch signal SS2 is disabled (a high voltage level is exemplified here), and the disabling switch signal SS2 turns-off the transistor T3. Therefore, the second terminal (i.e. node N1) of the capacitor C1 is able to receive the high voltage VDD1 through the turned-on transistor T1, which means that a voltage level of the node N1 (i.e. the gate of the transistor T2) will be equal to the high voltage VDD1.

At this moment, a voltage across the capacitor C1 is equal to VDT1-VDD1 (i.e. the data voltage VDT1 minus the high voltage VDD1). Furthermore, the power circuit 140 increases a voltage level of the system low voltage VSS1 to cause a voltage level of the cathode of the organic light emitting diode OLD to be higher than a voltage level of the anode thereof, which means that the organic light emitting diode OLD is reverse-biased, so that the organic light emitting diode OLD is turned-off. Thus, a situation is prevented that the drain of the transistor T2 receives the system low voltage VSS1 through the organic light emitting diode OLD and affects the voltage level of the node N1.

Figure 3B:
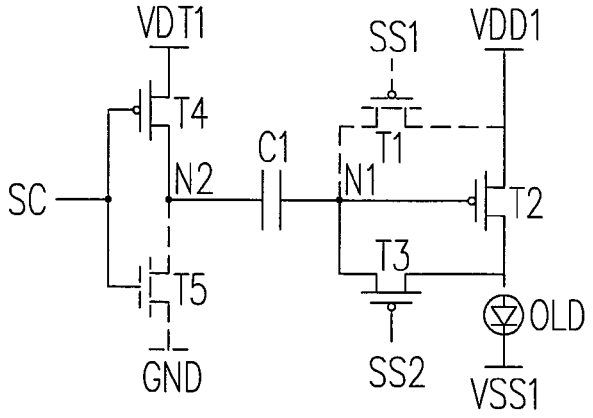
FIG. 3B is a schematic view of operation of pixels in a programming period according to the embodiment of FIGS. 2A and 2B.

FIG. 3B is a schematic view of operation of pixels in a programming period according to the embodiment of FIGS. 2A and 2B. Please refer to FIGS. 2A, 2B and 3B. In the programming period P2 in the present embodiment, the scan signal SC is enabled, and the enabling scan signal SC still turns-on the transistor T4 and turns-off the transistor T5. Therefore, the first terminal (i.e. node N2) of the capacitor C1 still receives the data voltage VDT 1 through the turned-on transistor T4 in the switch unit SWa. The switch signal SS1 is disabled (a high voltage level is exemplified here), and the disabling switch signal SS1 turns-off the transistor T1; the switch signal SS2 is enabled (a low voltage level is exemplified here), and the enabling switch signal SS2 turns-on the transistor T3.

At this moment, since the power circuit 140 still increases the voltage level of the system low voltage VSS1, the organic light emitting diode OLD remains in the turned-off state. The voltage level of the gate of the transistor T2 is lower than the high voltage VDD1. Meanwhile, a voltage difference between the voltage level of the gate of the transistor T2 and the high voltage VDD1 is greater than or equal to a threshold voltage of the transistor T2. Therefore, the transistor T2 is turned-on to enable the second terminal (i.e. node N1) of the capacitor C1 to receive the high voltage VDD1 through the turned-on transistors T2 and T3, so that the voltage level of the node N1 (i.e. the gate of the transistor T2) is equal to VDD1−|VTH| (i.e. the high voltage VDD1 minus the threshold voltage of the transistor T2). Here, the voltage across the capacitor C1 is equal to VDT1−VDD1+|VTH| (i.e. the data voltage VDT1 minus the high voltage VDD 1 and then plus the threshold voltage of the transistor T2).

Figure 3C:
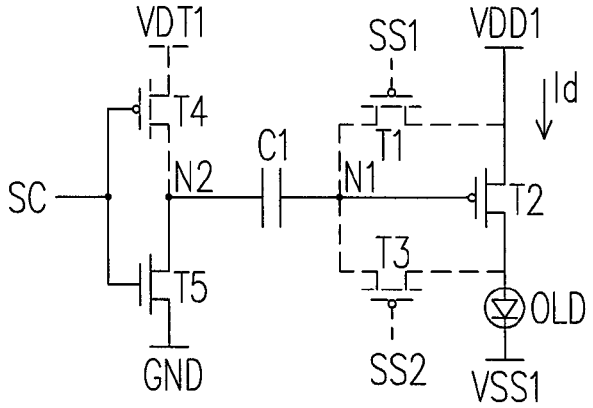
FIG. 3C is a schematic view of operation of pixels in a display period according to the embodiment of FIGS. 2A and 2B.

FIG. 3C is a schematic view of operation of pixels in a display period according to the embodiment of FIGS. 2A and 2B. Please refer to FIGS. 2A, 2B and 3C. In the display period P3 in the present embodiment, the scan signal SC is disabled (a high voltage level is exemplified here), and the disabling scan signal SC turns-off the transistor T4 and turns-on the transistor T5. At this moment, the first terminal (i.e. node N2) of the capacitor C1 receives the ground voltage GND through the transistor T5 in the switch unit SWa, which means that a voltage level of the node N2 is equal to the ground voltage GND. The switch signals SS1 and SS2 are disabled (a high voltage level is exemplified here), and the disabling switch signals SS1 and SS2 respectively turn-off the transistors T1 and T3, so that the voltage level of the node N1 is equal to VDD1−VDT1−|VTH| (i.e. the high voltage VDD1 minus the data voltage VDT1 and then minus the threshold voltage of the transistor T2). Furthermore, the power circuit 140 recovers the voltage level of the system low voltage VSS1 to cause the voltage level of the cathode of the organic light emitting diode OLD to be lower than the voltage level of the anode thereof, which means that the organic light emitting diode OLD is forward-biased, so that the organic light emitting diode OLD is turned-on.

In the display period P3, a current Id passing through the organic light emitting diode OLD meets $Id=K(VDD1-VG-|VTH|)^2$, i.e. a current coefficient K times the square of the high voltage VDD1 minus a gate voltage VG of the transistor T2 and minus the threshold voltage VTH of the transistor T2. Since the voltage level of the node N1 is equal to VDD1−VDT1−|VTH| (i.e. the gate voltage VG of the transistor T2), the equation of the current Id may be expanded as $Id=K(VDD1-|VTH|-VDD1+VDT1+|VTH|)^2$, and then simplified as $Id=K(VDT1)^2$, which means that the current Id passing through the organic light emitting diode OLD is only related to the data voltage VDT1. Therefore, the current Id passing through the organic light emitting diode OLD is neither affected by the threshold voltage VTH of the transistor T2 nor by the high voltage VDD1, which means that the current Id passing through the organic light emitting diode OLD is not affected by line impedance.

In this way, when materials or characteristics of the transistors T2 of different pixel PXa differ to result in different threshold voltages, the value of a current Id2 of each pixel is the same. Therefore, the brightness displayed by different pixels is consistent, and uneven display brightness does not occur. Furthermore, when the voltage levels of the high voltages VDD1 received by each pixel PXa differ due to different line impedance, the current Id is not affected, and thus display of the pixel PXa is not affected. Following the above, in cases where the current Id is stable, service life of the organic light emitting diode OLD is extended correspondingly.

Figure 4A:
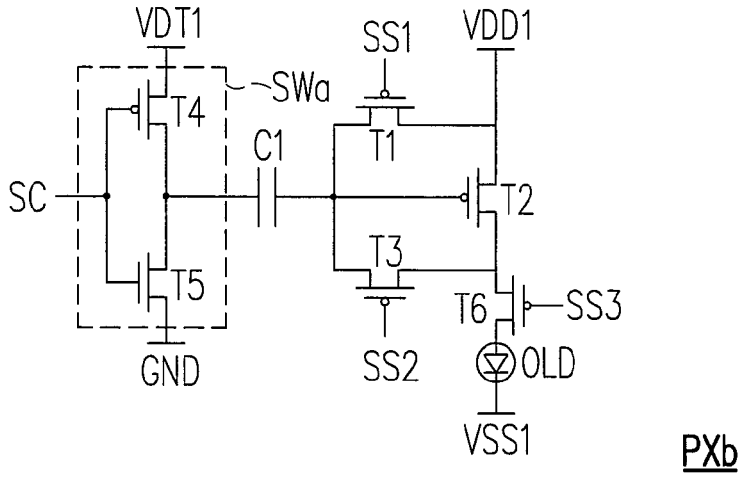
FIG. 4A illustrates another pixel circuit according to an embodiment of the invention in FIG. 1.

FIG. 4A illustrates another pixel circuit according to an embodiment of the invention in FIG. 1. Referring to FIGS. 1, 2A and 4A, in the present embodiment, a pixel PXb is approximately identical to the pixel PXa, wherein identical or similar elements are denoted by identical or similar reference numerals. A difference between the pixels PXa and PXb is that the pixel PXb further includes a transistor T6 (equivalent to a sixth transistor). Here, it is also assumed that the transistor T6 is a p-type transistor. A source (equivalent to a first terminal) of the transistor T6 is coupled to the drain of the transistor T2, a drain (equivalent to a second terminal) of the transistor T6 is coupled to the anode of the organic light emitting diode OLD, and a gate (equivalent to a control terminal) of the transistor T6 receives a switch signal SS3. The switch signal SS3 may be provided by the scan driver 120, but the embodiment of the invention is not limited thereto.

Figure 4B:
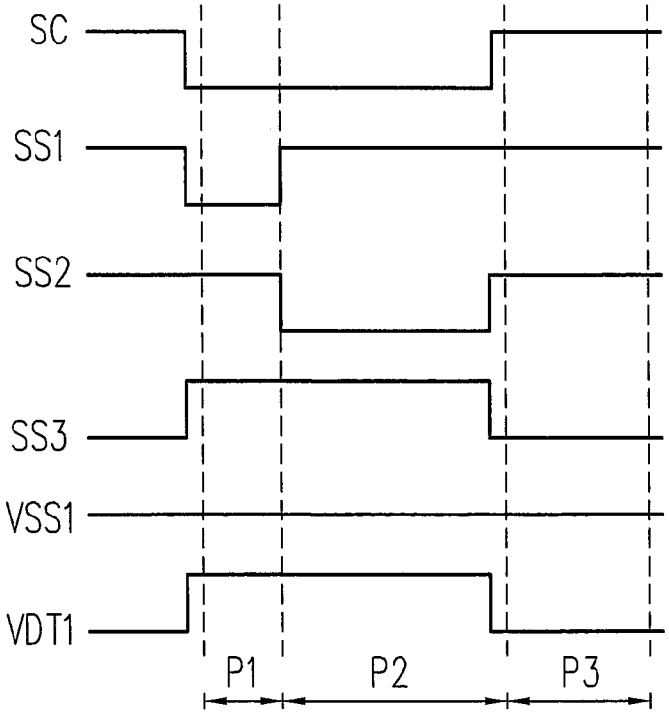
FIG. 4B is a schematic view of driving waveforms according to the embodiment of FIG. 4A.

FIG. 4B is a schematic view of driving waveforms according to the embodiment of FIG. 4A. Referring to FIGS. 2A, 2B, 4A and 4B, operations of the pixels PXa and PXb are approximately the same, and differences therebetween lie in the switch signal SS3 and the system low voltage VSS1. In the present embodiment, the switch signal SS3 is disabled in the pre-charging period P1 and the programming period P2 (a high voltage is exemplified here) to cause the transistor T6 to be turned-off to disconnect the transistor T2 from the system low voltage VSS1, and the switch signal SS3 is enabled in the display period P3 (a low voltage is exemplified here) to turn-on the transistor T6 to couple the transistor T2 to the organic light emitting diode OLD. Furthermore, the voltage level of the system low voltage VSS1 does not change.

Figure 5:
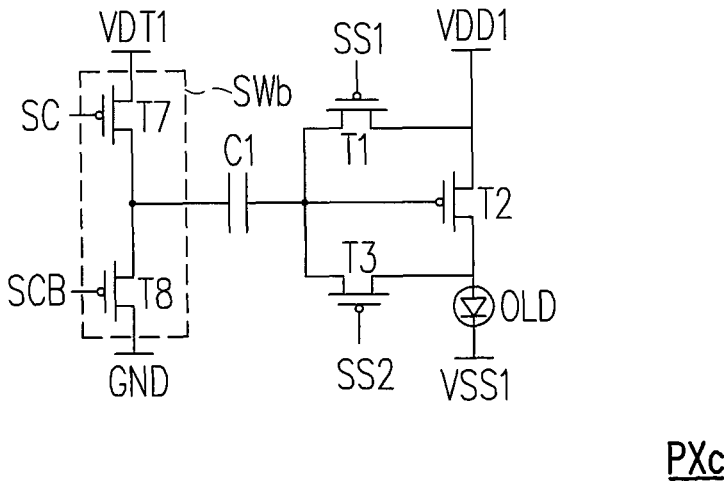
FIG. 5 illustrates still another pixel circuit an embodiment of the invention in FIG. 1.

FIG. 5 illustrates still another pixel circuit according to an embodiment of the invention in FIG. 1. Referring to FIGS. 1, 2A and 5, in the present embodiment, a pixel PXc is approximately identical to the pixel PXa, wherein a difference lies in a switch unit SWb, and identical or similar elements are denoted by identical or similar reference numerals. In the present embodiment, the switch unit SWb includes transistors T7 and T8 (equivalent to seventh and eighth transistors), wherein the transistors T7 and T8 are achieved by p-type transistors. A source (equivalent to a first terminal) of the transistor T7 receives the data voltage VDT1, a drain (equivalent to a second terminal) of the transistor T7 is coupled to the first terminal of the capacitor C1, and a gate (equivalent to a control terminal) of the transistor T7 receives the scan signal SC. A source (equivalent to a first terminal) of the transistor T8 is coupled to the first terminal of the capacitor C1, a drain (equivalent to a second terminal) of the transistor T8 is coupled to the ground voltage GND, and a gate (equivalent to a control terminal) of the transistor T8 receives a reverse signal SCB of the scan signal SC. All of the transistors in the pixel PXc are achieved by p-type transistors, thereby simplifying the process of the pixel PXc.

In summary, in the organic light emitting diode display apparatus and the pixel circuit thereof of the embodiments of the invention, the pixel circuit makes it possible that after driving the various switch signals and scan signals, the currents passing through the organic light emitting diode in the display period vary correspondingly to the data voltage, regardless of the high voltage and threshold voltage of the transistor. Accordingly, the influence of line impedance is eliminated and the display quality of the organic light emitting diode display apparatus is improved. In addition, service life of the organic light emitting diode is also extended.

It will be apparent to those skilled in the art that various modifications and variations can be made to the disclosed embodiments without departing from the scope or spirit of the invention. In view of the foregoing, it is intended that the invention covers modifications and variations of this disclosure provided that they fall within the scope of the following claims and their equivalents.

What is claimed is:

1. A pixel circuit, comprising:

a switch unit, receiving a data voltage, a scan signal and a ground voltage, and providing the data voltage or the ground voltage according to the scan signal;

a capacitor, a first terminal of the capacitor being coupled to the switch unit to receive the data voltage or the ground voltage;

a first transistor, a first terminal of the first transistor being coupled to a high voltage, a second terminal of the first transistor being coupled to a second terminal of the capacitor, and a control terminal of the first transistor receiving a first switch signal;

a second transistor, a first terminal of the second transistor being coupled to the high voltage, and a control terminal of the second transistor being coupled to the second terminal of the capacitor;

a third transistor, a first terminal of the third transistor being coupled to a second terminal of the second transistor, a second terminal of the third transistor being coupled to the second terminal of the capacitor, and a control terminal of the third transistor receiving a second switch signal; and an organic light emitting diode, an anode of the organic light emitting diode being coupled to the second terminal of the second transistor, and a cathode of the organic light emitting diode being coupled to a system low voltage;

wherein in a pre-charging period, the first terminal of the capacitor receives the data voltage through the switch unit and the second terminal of the capacitor receives the high voltage through the turned-on first transistor, in a programming period, the first terminal of the capacitor receives the data voltage through the switch unit and the second terminal of the capacitor receives the high voltage that is encoded level through the turned-on second and third transistors, and in a display period, the first terminal of the capacitor receives the ground voltage through the switch unit and the first and third transistors are turned-off, wherein in the pre-charging period, the first switch signal is enabled turns-on the first transistor and the second switch signal that is disabled turns-off the third transistor, in the programming period, the first switch signal that is disabled turns-off the first transistor and the second switch signal that is enabled turns-on the third transistor, and in the display period, the first switch signal that is disabled turns-off the first transistor and the second switch signal that is disabled turns-off the third transistor.

2. The pixel circuit as claimed in claim 1, wherein the switch unit comprises:

a fourth transistor, a first terminal of the fourth transistor being coupled to the data voltage, a second terminal of the fourth transistor being coupled to the first terminal of the capacitor, and a control terminal of the fourth transistor receiving the scan signal; and a fifth transistor, a first terminal of the fifth transistor being coupled to the first terminal of the capacitor, a second terminal of the fifth transistor being coupled to the ground voltage, and a control terminal of the fifth transistor receiving the scan signal;

wherein the fourth transistor is turned-on in the pre-charging period and the programming period, and the fifth transistor is turned-on in the display period.

3. The pixel circuit as claimed in claim 2, wherein the first transistor, the second transistor, the third transistor and the fourth transistor are p-type transistors, and the fifth transistor is an n-type transistor.

4. The pixel circuit as claimed in claim 3, wherein in the pre-charging period and the programming period, the scan signal that is enabled turns-on the fourth transistor and turns-off the fifth transistor, and in the display period, the scan signal that is disabled turns-off the fourth transistor and turns-on the fifth transistor.

5. The pixel circuit as claimed in claim 1, wherein the pixel circuit further comprises a sixth transistor, a first terminal of the sixth transistor being coupled to the second terminal of the second transistor, a second terminal of the sixth transistor being coupled to the anode of the organic light emitting diode, and a control terminal of the sixth transistor receiving a third switch signal, wherein the sixth transistor is turned-off in the pre-charging period and the programming period and is turned-on in the display period.

6. The pixel circuit as claimed in claim 1, wherein the switch unit comprises:

a seventh transistor, a first terminal of the seventh transistor being coupled to the data voltage, a second terminal of the seventh transistor being coupled to the first terminal of the capacitor, and a control terminal of the seventh transistor receiving the scan signal; and an eighth transistor, a first terminal of the eighth transistor being coupled to the first terminal of the capacitor, a second terminal of the eighth transistor being coupled to the ground voltage, and a control terminal of the eighth transistor receiving a reverse signal of the scan signal;

wherein the seventh transistor is turned-on in the pre-charging period and the programming period, and the eighth transistor is turned-on in the display period.

7. The pixel circuit as claimed in claim 6, wherein the first transistor, the second transistor, the third transistor, the seventh transistor and the eighth transistor are p-type transistors.

8. The pixel circuit as claimed in claim 7, wherein in the pre-charging period and the programming period, the scan signal that is enabled turns-on the sixth transistor and turns-off the eighth transistor, and in the display period, the scan signal that is disabled turns-off the seventh transistor and turns-on the eighth transistor.

9. The pixel circuit as claimed in claim 1, wherein in the pre-charging period and the programming period, a voltage level of the system low voltage is increased to subject the organic light emitting diode is reverse-biased and turned-off, and in the display period, the voltage level of the system low voltage is recovered.

10. An organic light emitting diode display apparatus, comprising:

a power circuit configured to provide a high voltage and a system low voltage; and a pixel circuit, comprising:

a switch unit, receiving a data voltage, a scan signal and a ground voltage, and providing the data voltage or the ground voltage according to the scan signal;

a capacitor, a first terminal of the capacitor being coupled to the switch unit to receive the data voltage or the ground voltage;

a first transistor, a first terminal of the first transistor being coupled to the high voltage, a second terminal of the first transistor being coupled to a second terminal of the capacitor, and a control terminal of the first transistor receiving a first switch signal;

a second transistor, a first terminal of the second transistor being coupled to the high voltage, and a control terminal of the second transistor being coupled to the second terminal of the capacitor;

a third transistor, a first terminal of the third transistor being coupled to a second terminal of the second transistor, a second terminal of the third transistor being coupled to the second terminal of the capacitor, and a control terminal of the third transistor receiving a second switch signal; and an organic light emitting diode, an anode of the organic light emitting diode being coupled to the second terminal of the second transistor, and a cathode of the organic light emitting diode being coupled to the system low voltage;

wherein in a pre-charging period, the first terminal of the capacitor receives the data voltage through the switch unit and the second terminal of the capacitor receives the high voltage through the turned-on first transistor, in a programming period, the first terminal of the capacitor receives the data voltage through the switch unit and the second terminal of the capacitor receives the high voltage that is encoded through the turned-on second and third transistors, and in a display period, the first terminal of the capacitor receives the ground voltage through the switch unit and the first and third transistors are turned-off, wherein in the pre-charging period, the first switch signal that is enabled turns-on the first transistor and the second switch signal that is disabled turns-off the third transistor, in the programming period, the first switch signal that is disabled turns-off the first transistor and the second switch signal that is enabled turns-on the third transistor, and in the display period, the first switch signal that is disabled turns-off the first transistor and the second switch signal that is disabled turns-off the third transistor.

11. The organic light emitting diode display apparatus as claimed in claim 10, wherein the switch unit comprises:

a fourth transistor, a first terminal of the fourth transistor being coupled to the data voltage, a second terminal of the fourth transistor being coupled to the first terminal of the capacitor, and a control terminal of the fourth transistor receiving the scan signal; and a fifth transistor, a first terminal of the fifth transistor being coupled to the first terminal of the capacitor, a second terminal of the fifth transistor being coupled to the ground voltage, and a control terminal of the fifth transistor receiving the scan signal;

wherein the fourth transistor is turned-on in the pre-charging period and the programming period, and the fifth transistor is turned-on in the display period.

12. The organic light emitting diode display apparatus as claimed in claim 11, wherein the first transistor, the second transistor, the third transistor and the fourth transistor are p-type transistors, and the fifth transistor is an n-type transistor.

13. The organic light emitting diode display apparatus as claimed in claim 12, wherein in the pre-charging period and the programming period, the scan signal that is enabled turns-on the fourth transistor and turns-off the fifth transistor, and in the display period, the scan signal that is disabled turns-off the fourth transistor and turns-on the fifth transistor.

14. The organic light emitting diode display apparatus as claimed in claim 10, wherein the pixel circuit further comprises a sixth transistor, a first terminal of the sixth transistor being coupled to the second terminal of the second transistor, a second terminal of the sixth transistor being coupled to the anode of the organic light emitting diode, and a control terminal of the sixth transistor receiving a third switch signal, wherein the sixth transistor is turned-off in the pre-charging period and the programming period and is turned-on in the display period.

15. The organic light emitting diode display apparatus as claimed in claim 10, wherein the switch unit comprises:

a seventh transistor, a first terminal of the seventh transistor being coupled to the data voltage, a second terminal of the seventh transistor being coupled to the first terminal of the capacitor, and a control terminal of the seventh transistor receiving the scan signal; and an eighth transistor, a first terminal of the eighth transistor being coupled to the first terminal of the capacitor, a second terminal of the eighth transistor being coupled to the ground voltage, and a control terminal of the eighth transistor receiving a reverse signal of the scan signal;

wherein the seventh transistor is turned-on in the pre-charging period and the programming period, and the eighth transistor is turned-on in the display period.

16. The organic light emitting diode display apparatus as claimed in claim 15, wherein the first transistor, the second transistor, the third transistor, the seventh transistor and the eighth transistor are p-type transistors.

17. The organic light emitting diode display apparatus as claimed in claim 16, wherein in the pre-charging period and the programming period, the scan signal that is enabled turns-on the seventh transistor and turns-off the eighth transistor, and in the display period, the scan signal that is disabled turns-off the seventh transistor and turns-on the eighth transistor.

18. The organic light emitting diode display apparatus as claimed in claim 10, wherein in the pre-charging period and the programming period, a voltage level of the system low voltage is increased to subject the organic light emitting diode is reverse-biased and turned-off, and in the display period, the voltage level of the system low voltage is recovered.

* * * * *